US007876035B2

(12) United States Patent
Yang et al.

(10) Patent No.: US 7,876,035 B2
(45) Date of Patent: Jan. 25, 2011

(54) PIXEL TUBE FOR FIELD-EMISSION DISPLAY DEVICE

(75) Inventors: Yuan-Chao Yang, Beijing (CN); Liang Liu, Beiijng (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 381 days.

(21) Appl. No.: 11/957,318

(22) Filed: Dec. 14, 2007

(65) Prior Publication Data

US 2009/0001867 A1 Jan. 1, 2009

(30) Foreign Application Priority Data

Jun. 29, 2007 (CN) ..... 200710076271

(51) Int. Cl.
*H01J 63/04* (2006.01)
*H01J 1/62* (2006.01)
*H01J 9/02* (2006.01)

(52) U.S. Cl. ..... 313/495; 313/309; 313/496; 313/310; 445/25; 445/51

(58) Field of Classification Search ..... None
See application file for complete search history.

(56) References Cited

U.S. PATENT DOCUMENTS 4,825,066 A * 4/1989 Nakamura et al. ..... 250/207
6,692,327 B1 * 2/2004 Deguchi et al. ..... 445/49
2002/0084502 A1 * 7/2002 Jang et al. ..... 257/432
2002/0197752 A1 * 12/2002 Choi ..... 438/20
2004/0195957 A1 * 10/2004 Hu et al. ..... 313/495
2005/0142978 A1 6/2005 Yotani et al.
2006/0132048 A1 * 6/2006 Popovich ..... 315/160
2006/0163995 A1 * 7/2006 Xu et al. ..... 313/310

OTHER PUBLICATIONS

Wei et al. , efficient fabrication of field electron emitters from multiwalled carbon nanotube yarns, Applied Science Letters 89, Aug. 2006.*

* cited by examiner

*Primary Examiner*—Nimeshkumar D Patel
*Assistant Examiner*—Tracie Green
(74) *Attorney, Agent, or Firm*—Jeffrey T. Knapp

(57) ABSTRACT

A pixel tube for a field-emission illumination/display device includes a sealed container, an anode electrode, a cathode electrode and a shielding electrode. The sealed container has a light permeable portion. The anode electrode is disposed in the sealed container and adjacent to the light permeable portion. The cathode electrode is arranged in the sealed container facing the anode electrode and includes a cathode supporter and a carbon nanotube yarn, the carbon nanotube yarn attached to the cathode supporter and extending toward the anode electrode for emitting electrons therefrom. The shielding electrode is disposed on a surface of the sealed container and surrounds/encircles the carbon nanotube yarn.

20 Claims, 2 Drawing Sheets

PIXEL TUBE FOR FIELD-EMISSION DISPLAY DEVICE

BACKGROUND

1. Field of the Invention

The invention relates to field emission display devices and, more particularly, to a pixel tube for a field emission display device.

2. Discussion of Related Art

Field-emission illumination/display devices are based on emission of electrons in a vacuum. Electrons are emitted from micron-sized (or less) tips in a strong electric field, and the electrons are accelerated and collide with a fluorescent material. The fluorescent material then emits visible light. Such field emission devices are thin, are light weight, and provide high levels of brightness.

Conventionally, a material of the tips has generally been selected from the group consisting of molybdenum (Mo) and silicon (Si). With the development of nano-technology, carbon nanotubes (CNTs) have also been used for the tips of the field emission devices.

A conventional pixel tube includes a cathode electrode and an anode electrode arranged over the cathode electrode. The cathode electrode includes a CNT yarn used as an emitter. The anode electrode is generally a transparent conductive layer disposed on a substrate. At least one fluorescent layer is formed on the anode electrode and faces the CNT yarn. In operation, electrons emitted from the CNT yarn are, under an electric field applied by the cathode electrode and the anode electrode, accelerated, and then collide with a fluorescent material of the fluorescent layer. The collision of the electrons upon the fluorescent layer causes such layer to fluoresce and thus emit light therefrom. The CNT yarn has an excellent electric field electron emission efficiency to thereby obtain a large emission current at a low applied voltage.

However, the fluorescent layer tend to directly experience the large emission current at a low voltage, which can greatly decrease the irradiance efficiency of the fluorescent. Moreover, the collision of electrons of large emission current can potentially damage the fluorescent material. Thus, the life of the pixel tube can be compromised.

What is needed, therefore, is a pixel tube for a field-emission illumination/display device that operates at a high voltage to obtain a small emission current and that has a long lifetime.

SUMMARY

The present invention relates to a pixel tube for a field-emission illumination/display device. The pixel tube for a field-emission illumination/display device includes a sealed container, an anode electrode, a cathode electrode and a shielding electrode. The sealed container has a light permeable portion. The anode electrode is disposed in the sealed container and adjacent to the light permeable portion. The cathode electrode is arranged in the sealed container facing the anode electrode and includes a cathode supporter and a carbon nanotube yarn, the carbon nanotube yarn attached to the cathode supporter and extending toward the anode electrode for emitting electrons therefrom. The shielding electrode is disposed on a surface of the sealed container and surrounds/encircles the carbon nanotube yarn.

Other advantages and novel features of the pixel tube for a field-emission illumination/display device will become more apparent from the following detailed description of preferred embodiments, when taken in conjunction with the accompanying drawings.

BRIEF DESCRIPTION OF THE DRAWINGS

Many aspects of the pixel tube for a field-emission illumination/display device can be better understood with reference to the following drawings. The components in the drawings are not necessarily to scale, the emphasis instead being placed upon clearly illustrating the principles of the pixel tube for a field-emission illumination/display device.

Figure 1:
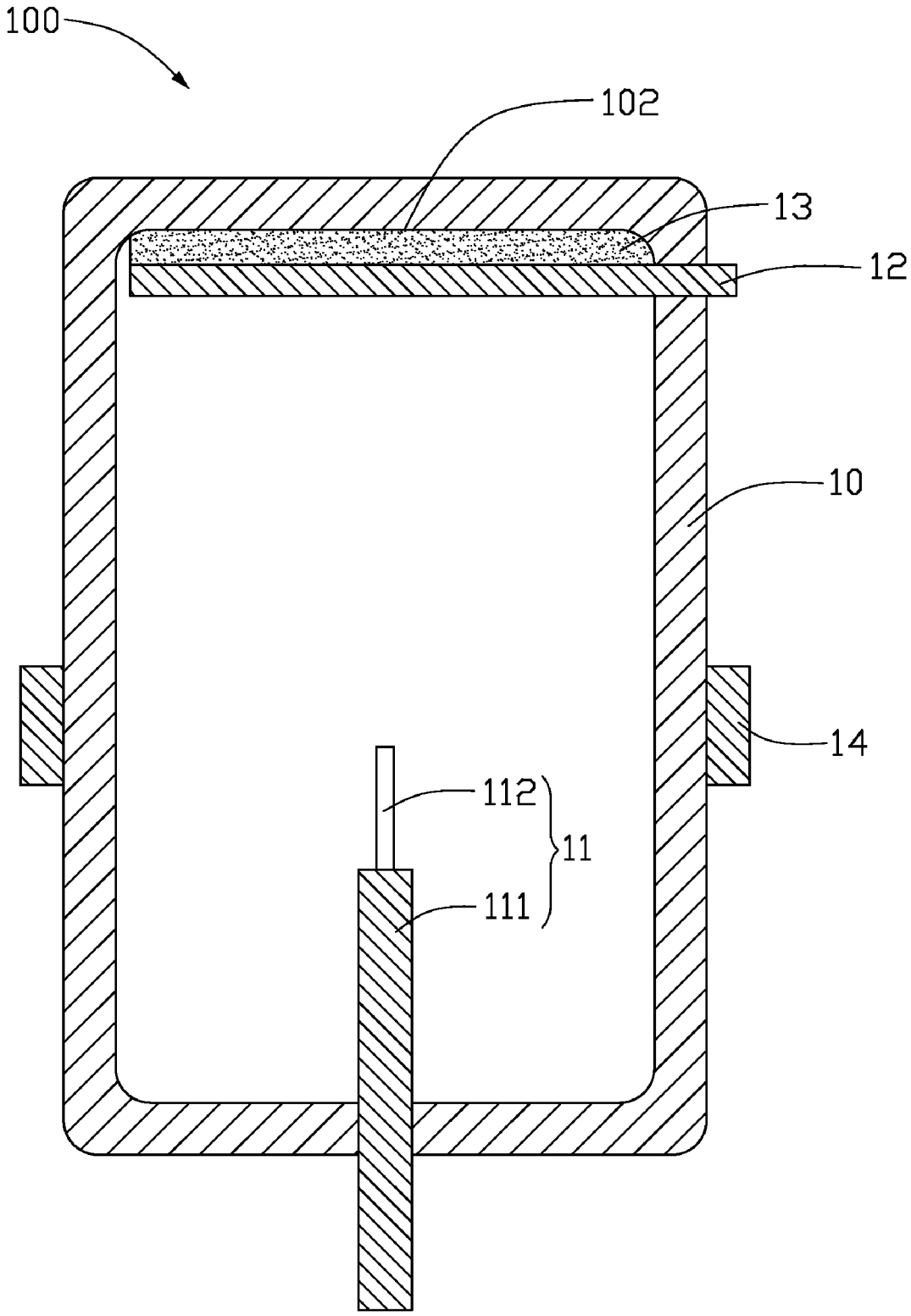
FIG. 1 is a schematic, cross-sectional view of a pixel tube for a field-emission illumination/display device, in accordance with a first present embodiment.

Corresponding reference characters indicate corresponding parts throughout the several views. The exemplifications set out herein illustrate at least one preferred embodiment of the pixel tube for a field-emission illumination/display device, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the pixel tube for a field-emission illumination/display device.

Referring to FIG. 1, a pixel tube for a field-emission illumination/display device 100 includes a sealed container 10 having a light permeable portion 102; an anode electrode 12 disposed in the sealed container 10 and adjacent to the light permeable portion 102; a cathode electrode 11 arranged in the sealed container 10 and including a cathode supporter 111 and a carbon nanotube yarn 112 disposed thereon, the carbon nanotube yarn 112 extending toward the anode electrode 12 for emitting electrons therefrom, one end of the cathode supporter 111 is inside the sealed container 10 (i.e., extends into the interior of the sealed container 10), an intermediate portion of the cathode supporter 111 is hermetically sealed in an end wall of the sealed container 10, and the other end of the cathode supporter 111 extends to the outside of the sealed container 10 to facilitate electrical connection thereof with a power source (not shown), and a shielding electrode 14 is disposed on a surface of the sealed container 10 and surrounds/encircles the carbon nanotube yarn 112. The pixel tube for a field-emission illumination device 100 further includes a phosphor layer 13.

The sealed container 10 is a hollow member that defines an inner space, the inner space being held in a vacuum. The sealed container 10 is light permeable. Advantageously, the sealed container 10 is transparent. The sealed container 10 according to the present embodiment can be made of a non-metal material, for example, quartz or glass. Such materials as quartz or glass are beneficial in that they are electrically insulative and facilitate a hermetic seal. The main portion of the sealed container 10 in cross-section can be, for example, a circle, a quadrangle, a triangle, or a polygon. In the illustrated embodiment, the main portion of the sealed container is a cylinder. The light-permeable portion 102 may be a planar surface, a spherical surface, or an aspherical surface and can be selected according to the desired application.

In order to maintain the vacuum of the inner space of the sealed container 10, a getter (not shown) may be arranged therein to absorb residual gas inside the sealed container 10. The getter should, rather appropriately, be arranged on an inner surface of the sealed container 10. The getter may be an evaporable getter introduced using high frequency heating. The getter also can be a non-evaporable getter, and one or both types of getters could be employed.

The anode electrode 12 is a transparent film with good electrical conductivity. In the present embodiment, the anode electrode 12 is, an indium tin oxide film or an electron permeable film (e.g., an aluminum film). When the transparent conductive film is employed, the phosphor layer 13 can be deposited on the side of the anode electrode 12 facing the cathode electrode 11. When the electron permeable film is employed, the phosphor layer 13 can be deposited on the inner surface of the sealed container 10 or on the side of the anode electrode 12 facing away from the cathode electrode 11. According to the present embodiment, the anode electrode 12 is an aluminum film, the phosphor layer 13 deposited on the side of the anode electrode 12 facing away from the cathode electrode 11, and the phosphor layer 13 contains a fluorescent material that emits white or colored light (depending on the material chosen) when bombarded with electrons.

The cathode supporter 111 is made of conductive material, supplies support for the carbon nanotube yarn 112 and facilitates an electrical connection of the carbon nanotube yarn 112 with a power source (not shown). The carbon nanotube yarn 112 is mechanically and electrically attached to the cathode supporter 111 and extends toward the light permeable portion 102. The carbon nanotube yarn 112 is configured for emitting electrons therefrom. Opportunely, the carbon nanotube yarn 112 extends substantially perpendicular to the light permeable portion 102. The carbon nanotube yarn 112 includes a plurality of carbon nanotubes arranged approximately parallel to one another and to the axis of the cathode supporter 111. The carbon nanotube yarn 112 has a length in an approximate range from 0.1 millimeters to 10 millimeters, and a diameter in an approximate range from 1 micrometer to 100 micrometers.

The carbon nanotube yarn 112 can be obtained by drawing a bundle of carbon nanotubes from a super-aligned carbon nanotube array to be held together by Van der Waals force interactions. The carbon nanotube yarn 112 is multi-walled carbon nanotube. Before the carbon nanotube yarn 112 is connected to the cathode supporter 111 by a conductive adhesive (eg. silver adhesive), it is soaked in an ethanol solvent, and is thermally treated by supplying a current thereto in vacuum. Since the untreated carbon nanotube yarn 112 is composed of a plurality of bundles of CNTs, the untreated CNT yarn has a high surface area to volume ratio and thus may easily adhere to other objects. During the surface treatment, the carbon nanotube yarn 112 shrinks due to factors such as surface tension. The surface area to volume ratio and diameter of the treated carbon nanotube yarn 112 is reduced. Accordingly, the adhesiveness of the carbon nanotube yarn 112 is lowered or eliminated, and strength and toughness of the carbon nanotube yarn 112 is improved. The organic solvent may be a volatilizable organic solvent, such as ethanol, methanol, acetone, dichloroethane, chloroform, and any combination thereof. After the above processes, the carbon nanotube yarn 112 has improved electrical conducting and mechanical strength.

The shielding electrode 14 is annular. The shielding electrode 14 is bonded on the outside surface of the sealed container 10 and surrounds the track of the electrons emitted by the carbon nanotube yarn 112. In operation, voltages are separately supplied to the anode electrode 12, and the cathode electrode 11 and electrons will emanate from the carbon nanotube yarn 112. The electrons emit and travel from the cathode electrode 11 and transmit through the anode electrode 12 and strike the phosphor layer 13 in a manner such that visible light is emitted. Thus, the track of the electrons is approximately along the central axis of the sealed container 10, and, thus, the shielding electrode 14 can be disposed surrounding/encircling the longitudinal axis of the sealed container 10, along which the cathode electrode 11 is essentially directed. Rather appropriately, the cross-sectional shape of the shielding electrode 14 is the same as that of the sealed container 10, and the shielding electrode 14 and the sealed container 10 are disposed coaxially. Finally, as can be seen from FIG. 1, by nature of the coaxial placement of the carbon nanotube yarn 112 and the shielding electrode 14, the shielding electrode 14 is equi-radially displaced from the carbon nanotube yarn 112.

Figure 2:
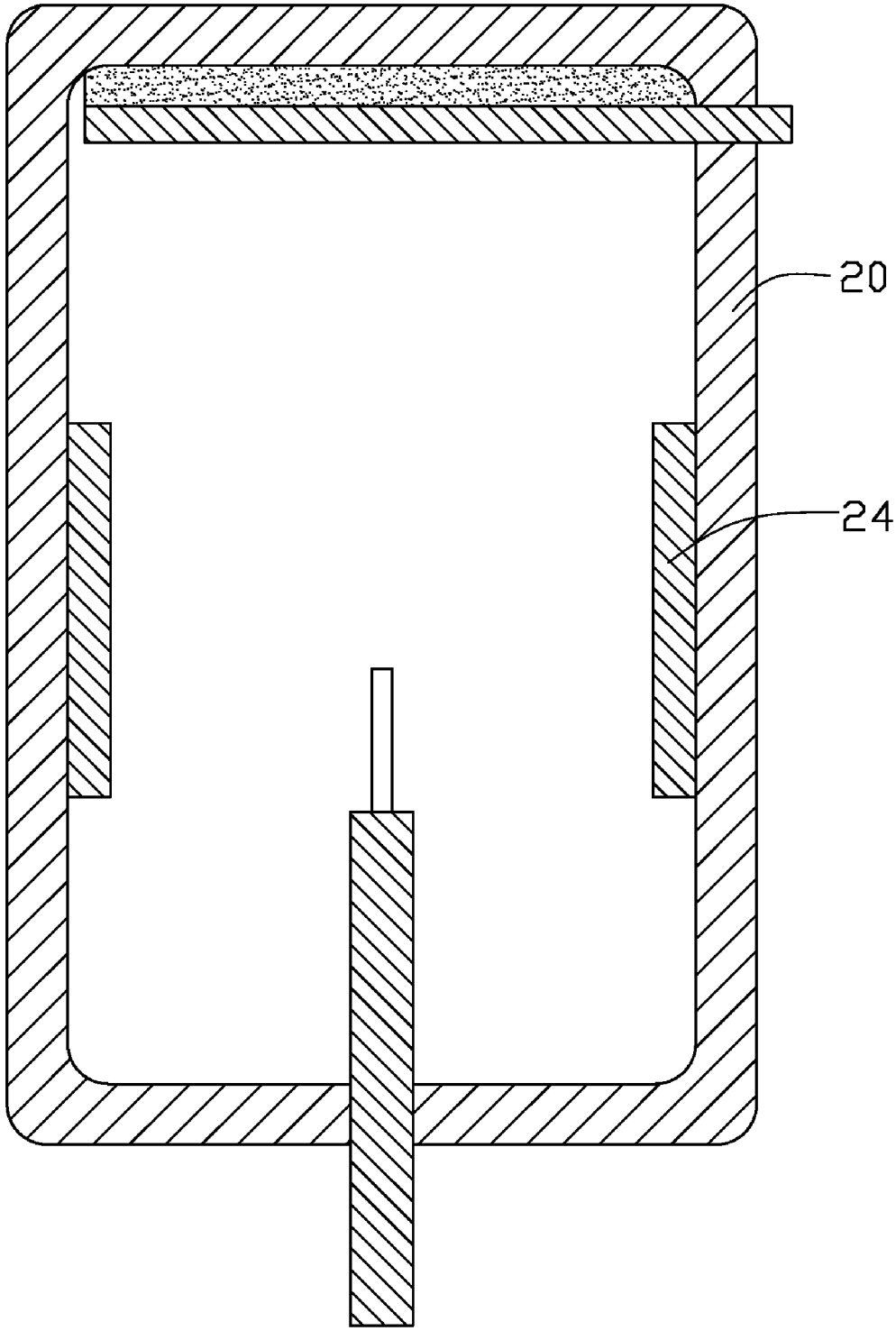
FIG. 2 is a schematic, cross-sectional view of a pixel tube for a field-emission illumination/display device, in accordance with a second present embodiment.

Referring to FIG. 2, the pixel tube for a field-emission illumination device 200, in accordance with a second present embodiment, is provided. The pixel tube for a field-emission illumination/display device 200 is similar to the pixel tube for a field-emission illumination/display device 100, except that the shielding electrode 14 is a ring-shaped conductive film disposed on an inner surface or outside surface of the sealed container 10. The shielding electrode 14 is, beneficially, a metal film with good electrical conductivity and good oxidation resistance (the latter helping to ensure good long-term conductivity). The metal can, e.g., be selected from a group consisting of gold, silver, copper, and aluminum. In the present embodiment, the shielding electrode 14 is, rather advantageously, a gold film. The shielding electrode 14 can, usefully, be formed by means of deposition or sputtering of such a film on either the inner or outer surface of the sealed container 10. The shielding electrode 14 should, most appropriately, be formed before packaging and sealing the container 10, when, in particular, the shielding electrode 14 is to be disposed on the inner surface of the sealed container 10.

In operation, when putting/placing a voltage between the cathode electrode(s) and the anode electrode, electrons will emanate from the carbon nanotube yarn. Since the shielding electrode is able to shield a high voltage of the anode electrode, it is to be understooded that the electric field of the surface of the carbon nanotube yarn can be reduced. The distance between the shielding electrode and the cathode electrode determines shielding effect of the shielding electrode. When the distance is shorter, and the effect is more apparent/pronounced. Thus, the smaller of the diameter of the pixel tube for a field-emission illumination/display device, the shorter of the distance between the shielding electrode and the cathode electrode, and, thus, the shielding effect is more obvious/distinct. As a result of the reduced electric field experienced at the surface of the carbon nanotube yarn, the emission current is able to be low, even under a high working voltage. As a result, the pixel tube for a field-emission illumination/display device has an excellent emission efficiency and a long service life.

What is more, since the shielding electrode is disposed around the sealed container, and the shielding electrode has a reject effect on the electrons emitted from the carbon nanotube yarn, the electrons, under the reject effect, fly/project to the anode electrode in a more concentrated manner, so as to avoid, generally, hitting the inner surface of the sealed container. Accordingly, the production of X-rays is also better avoided, as a result, and the emission efficiency is increased.

Because of the shielding effect of the shielding barrel, the field emission device can operate with a higher level of stability under high voltages.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A pixel tube for a field-emission display device, comprising:

a sealed container having a light permeable portion;

an anode electrode positioned in the sealed container at a position adjacent to the light permeable portion;

a cathode electrode arranged in the sealed container and facing the anode electrode, and comprising a cathode supporter and one carbon nanotube yarn attached to the cathode supporter and extending toward the anode electrode, the carbon nanotube yarn being supported by the cathode supporter, the carbon nanotube yarn being configured for emitting electrons therefrom; and a shielding electrode positioned on a surface of the sealed container, the shielding electrode surrounding the carbon nanotube yarn, wherein the surface of the sealed container surrounds the carbon nanotube yarn.

2. The pixel tube as claimed in claim 1, wherein the shielding electrode is annular.

3. The pixel tube as claimed in claim 1, wherein the shielding electrode is a conductive film.

4. The pixel tube as claimed in claim 3, wherein the conductive film is comprised of a material selected from the group consisting of gold, silver, copper, and aluminium.

5. The pixel tube as claimed in claim 2, wherein the shielding electrode and the sealed container are coaxial.

6. The pixel tube as claimed in claim 3, wherein the shielding electrode is directly positioned on an inner surface or an outside surface of the sealed container.

7. The pixel tube as claimed in claim 1, wherein a conductive adhesive connects the carbon nanotube yarn and the cathode supporter.

8. The pixel tube as claimed in claim 1, wherein an end of the carbon nanotube yarn is welded to the cathode supporter.

9. The pixel tube as claimed in claim 1, wherein the anode electrode is an aluminum film.

10. The pixel tube as claimed in claim 1, wherein the carbon nanotube yarn has a length in a range from about 0.1 millimeters to about 10 millimeters.

11. The pixel tube as claimed in claim 1, wherein the carbon nanotube yarn has a diameter in a range from about 1 micrometer to about 1 millimeter.

12. The pixel tube as claimed in claim 1, further comprising a phosphor layer arranged on the light permeable portion in the sealed container.

13. The pixel tube as claimed in claim 1, wherein the shielding electrode is outside of the sealed container.

14. A pixel tube for a field-emission display device, comprising:

a sealed container having two opposite ends, the sealed container further comprising a light permeable portion arranged at one end;

an anode electrode and a cathode electrode arranged on the two ends, respectively, the anode electrode being adjacent to the light permeable portion, the cathode electrode comprising a cathode supporter and at least one emitter positioned on the cathode supporter and extending towards the anode electrode; and a shielding electrode surrounding the at least one emitter and contacting a surface of the sealed container, wherein the surface of the sealed container surrounds the at least one emitter.

15. The pixel tube as claimed in claim 14, wherein the shielding electrode is attached to an inner circumferential surface of the sealed container.

16. The pixel tube as claimed in claim 14, wherein the shielding electrode is spaced from the carbon nanotube yarn, and the surface of the sealed container is located between the shielding electrode and the carbon nanotube yarn.

17. The pixel tube as claimed in claim 14, wherein the cathode supporter has two ends opposing each other, one end of the cathode supporter is inside the sealed container and in contact with the at least one emitter, an intermediate portion of the cathode supporter is substantially hermetically sealed in an end wall of the sealed container, and the other end of the cathode supporter extends to outside of the sealed container.

18. A pixel tube for a field-emission display device, comprising:

a sealed container having a light permeable portion;

an anode electrode positioned in the sealed container at a position adjacent to the light permeable portion;

a cathode electrode arranged in the sealed container and facing the anode electrode, and comprising a cathode supporter and a carbon nanotube yarn, wherein the carbon nanotube yarn is attached to the cathode supporter and extends toward the anode electrode, the carbon nanotube yarn being configured for emitting electrons therefrom; and a shielding electrode positioned on a surface of the sealed container, the shielding electrode surrounding the carbon nanotube yarn, wherein the shielding electrode is annular, and the shielding electrode and the sealed container are coaxial, the surface of the sealed container surrounds the carbon nanotube yarn, and the shielding electrode is outside the sealed container.

19. The pixel tube as claimed in claim 1, wherein the cathode supporter has two ends opposing to each other, one end of the cathode supporter is inside the sealed container extending towards the anode electrode, an intermediate portion of the cathode supporter is hermetically sealed in an end wall of the sealed container, and the other end of the cathode supporter extends outside of the sealed container.

20. The pixel tube as claimed in claim 1, wherein only one end of the carbon nanotube yarn is attached to the cathode supporter, and the carbon nanotube yarn extends substantially toward the anode electrode along a direction from an end of the cathode supporter to the anode electrode.

* * * * *